US009783962B1

(12) United States Patent
Hitchcock

(10) Patent No.: US 9,783,962 B1
(45) Date of Patent: Oct. 10, 2017

(54) FRONT LOADER

(71) Applicant: YANMAR CO., LTD., Chayamachi, Kita-ku, Osaka-shi (JP)

(72) Inventor: Daniel Hitchcock, Adairsville, GA (US)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 15/254,566

(22) Filed: Sep. 1, 2016

(51) Int. Cl.
*E02F 9/26* (2006.01)
*E02F 3/34* (2006.01)

(52) U.S. Cl.
CPC ..... *E02F 9/264* (2013.01); *E02F 3/3408* (2013.01); *E02F 3/3417* (2013.01)

(58) Field of Classification Search
CPC ..... E02F 9/264
USPC ..... 414/698; 37/906; 172/430
See application file for complete search history.

(56) References Cited

U.S. PATENT DOCUMENTS 3,198,360 A * 8/1965 Strader ..... E02F 3/432 414/698
3,796,335 A * 3/1974 Smith ..... E02F 9/26 116/303
4,604,025 A 8/1986 Hammoud
7,413,397 B2 8/2008 Muramoto et al.
7,430,983 B2 * 10/2008 Hicok ..... E02F 3/431 116/313
8,038,380 B2 10/2011 Opperud
2014/0064898 A1 * 3/2014 Nishi ..... E02F 3/3417 414/685

FOREIGN PATENT DOCUMENTS

JP H06-37785 5/1994
JP H08-113962 5/1996
JP 2501437 6/1996
JP 2006027480 2/2006
JP 2006028934 2/2006
JP CN203145085 8/2013
JP 2015150974 8/2015

* cited by examiner

*Primary Examiner* — Gerald McClain
*Assistant Examiner* — Ronald Jarrett
(74) *Attorney, Agent, or Firm* — Andrew F. Young, Esq.; Lackenbach Siegel, LLP

(57) ABSTRACT

A front loader comprises an arm, a work implement supported to a tip portion of the arm, and an angle display device. The angle display device includes a gauge member, an indicator, a shaft member, and a conversion mechanism. The gauge member has a scale indicating an angle of the work implement relative to the arm. The indicator is movable relative to the gauge member according to variations of the angle of the work implement. The shaft member is movable along the arm according to variations of the angle of the work implement. The conversion mechanism changes a relative position of the gauge member and the indicator according to the movement of the shaft member. The conversion mechanism is configured so as to cause the indicator to rotate relative to the gauge member around a rotation axis being parallel to an axis of the shaft member in one direction or another direction according to the movement of the shaft member.

4 Claims, 11 Drawing Sheets

FRONT LOADER

BACKGROUND OF THE INVENTION

Field of the Invention

The present invention relates to a front loader mounted to a work vehicle.

Description of the Related Art

A front loader including a pair of left and right main frames, a pair of left and right arms (booms), and a bucket serving as a work implement has conventionally been known. One such front loader is disclosed in US Patent publication No. 2014/0064898.

The front loader includes an indicator device for maintaining a posture of the bucket. The indicator device can indicate that the bucket stays in the same posture with the booms set to be at any height position. An operator operates the front loader while checking the indicator device to move the booms upward and downward without changing an angle of the bucket.

The indicator device described in the document only indicates whether the bucket stays in the same posture, that is, whether the bucket is maintained to be in an posture of a predetermined angle, and does not indicate an angle of the bucket relative to the booms. The operator has to check an amount of displacement along an axial direction between a rear end surface of an indicator rod and a rear end surface of a guide tube, to recognize the angle of the bucket or alternatively, the operator has to check the bucket itself. Thus, the indicator device can be regarded as having a configuration of making the operator determine the positional relationship between the each of the rear end surface of the indicator rod and the guide tube, through an operator's perspective to recognize the angle of the bucket. This means that when the indicator device is used, the operator only has own perspective to rely on for accurately determining the angle of the bucket. Thus, visibility of the indicator device has been poor.

Thus, a configuration of achieving high visibility of an angle display device indicating an angle of a work implement of a front loader has been desired.

ASPECTS AND SUMMARY OF THE INVENTION

An object of the present invention is to provide a front loader including an angle display device indicating an angle of a work implement and a configuration that can achieve high visibility of the angle display device.

To achieve the object, a front loader according to the present invention comprises an arm, a work implement supported to a tip portion of the arm, and an angle display device. The angle display device includes a gauge member, an indicator, a shaft member, and a conversion mechanism. The gauge member has scale marks indicating an angle of the work implement relative to the arm. The indicator is movable relative to the gauge member according to variations of the angle of the work implement. The shaft member is movable along the arm according to variations of the angle of the work implement. The conversion mechanism changes a relative position of the gauge member and the indicator according to the movement of the shaft member. The conversion mechanism is configured so as to cause the indicator to rotate relative to the gauge member around an axis being parallel to an axis of the shaft member in one direction or another direction according to the movement of the shaft member.

With this configuration, the angle of the work implement can be indicated with the indicator rotating relative to the gauge member according to variations of the angle of the work implement. Thus, an operator can easily visually check the angle of the work implement from the position of the indicator on the scale marks.

Preferably, the shaft member includes a guide tube. In addition, the conversion mechanism includes a rotation rod and a guide member, the rotation rod includes a helical protrusion and a part, a shape of a transverse section of the part on which the helical protrusion is formed is polygon, the guide member is provided integrally with the guide tube so as to close partly an opening of an end surface of the guide tube, the guide member is formed with two contact surfaces, one end of the rotation rod is inserted into the guide tube from the end surface while helical protrusion contacts two contact surfaces of the guide member, and the indicator is attached to another end portion of the rotation rod integrally with the rotation rod.

In this configuration, the rotation rod rotates in one direction or the other direction around the axis of the rotation rod, with the helical protrusion of the rotation rod sliding along the two contact surfaces in accordance with the movement of the shaft member. Thus, the angle of the work implement can be indicated with the indicator rotating with the rotation rod according to variations of the angle of the work implement.

Preferably, the other end portion of the rotation rod is restricted to move in axial direction of the rotation rod relative to the arm and is supported by the arm so as to be rotatable relative to the arm with the gauge member and the indicator around a predetermined rotation axis.

In this configuration, the rotation rod can stably rotate based on variations of a length between one end of the shaft member and the other end of the rotation rod in the axial direction of the angle display device.

Preferably, the shaft member includes a guide tube. In addition, the conversion mechanism includes a rotation rod and a guide member, the rotation rod includes a helical protrusion and a part, a shape of a transverse section of the part on which the helical protrusion is formed is polygon, the guide member is provided integrally with the guide tube so as to close partly an opening of an end surface of the guide tube, the guide member is formed with a plurality of projections, one end of the rotation rod is inserted into the guide tube from the end surface while each the plurality of projections of the guide member contact respective different sides of the polygonal transverse section of the rotation rod, and the indicator is attached to another end portion of the rotation rod integrally with the rotation rod.

In this configuration, the rotation rod rotates in one direction or the other direction around the axis of the rotation rod, with the helical protrusion of the rotation rod contacting and sliding on the plurality of protrusions in accordance with the movement of the shaft member. Thus, the angle of the work implement can be indicated with the indicator rotating with the rotation rod according to variations of the angle of the work implement.

Features and effects described above or not described above will be more apparent through a detailed description of the invention based on the attached drawings.

DETAILED DESCRIPTION OF THE INVENTION

Figure 1:
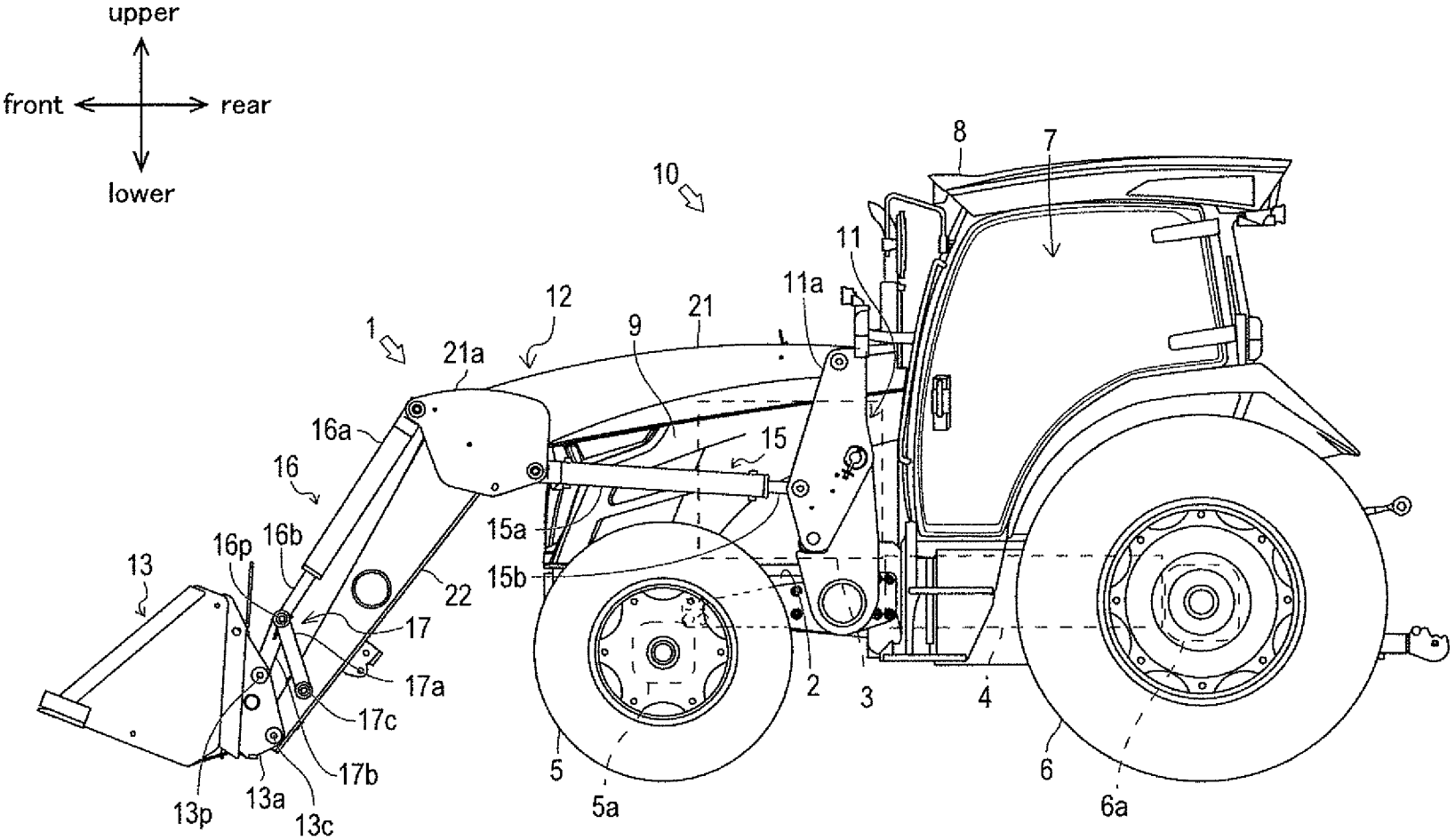
FIG. 1 is a side view of a tractor including a front loader according to an embodiment of the present invention.

FIG. 1 illustrates a tractor 10 as a work vehicle. The tractor 10 has a front portion where a front loader 1 according to an embodiment of the present invention can be attached. The tractor 10 has various unillustrated work implements (such as a rotary) mounted thereon, and performs various works using the mounted work implement.

A front and rear direction and an upper and lower direction of the tractor 10 and the front loader 1 are defined in FIG. 1.

The tractor 10 includes a body frame 2 having a longitudinal direction extending along the front and rear direction, and has a rear portion coupled to an engine 3. The engine 3 has a rear portion coupled to a transmission casing 4, connected in a longitudinal direction extending along the front and rear direction, that accommodates a part of a power transmission mechanism (not illustrated) of the tractor 10. The body frame 2 has a front portion supported by a pair of left and right front wheels 5, via a front axle 5*a* and the transmission casing 4 has the rear portion supported to a pair of left and right rear wheels 6 via a rear axle 6*a*.

Power of the engine 3, as a result of a reduction by the power transmission mechanism, can be transmitted to the pair of left and right front wheels 5 via the front axle 5*a* and to the pair of left and right rear wheels 6 via the rear axle 6*a*. The pair of left and right front wheels 5 and the pair of left and right rear wheels 6 are driven and rotate upon receiving power from the engine 3, and thus the tractor 10 travels.

The tractor 10 further includes a hydraulic pump (not illustrated) that is driven by power from the engine 3. The hydraulic pump pumps hydraulic oil that can be supplied to the front loader 1 attached to the body frame 2 and other work implements. Thus, the various work implements receiving power from the engine 3 to be driven.

A driving operation portion 7, on which an operator get to operate the tractor 10, is disposed above the transmission casing 4, and is covered with a cabin 8. The cabin 8 includes a driver's seat. Further, a hood 9 disposed in front of the cabin 8 covers the engine 3.

The front loader 1 is described with reference to FIGS. 2 and 3. An upper and lower direction, a front and rear direction, and a left and right direction of the front loader 1 are defined in FIG. 2.

The front loader 1 is a work device, an operation of which involves hoisting and lowering a work implement 13 such as a bucket. The front loader 1 mainly includes main frames 11, arms 12, the work implement 13, lift cylinders 15, and dump cylinders 16.

A pair of the left and right main frames 11 is a section of the front loader 1 that are attached to the tractor 10, and each extend in an upward and forward direction from the front portion of the tractor 10. The main frames 11 are each fixed to a corresponding one of left and right side surfaces of the body frame 2. The main frame 11 fixed to the body frame 2 has an posture of extending in the upward and forward from the left and the right side surfaces of the body frame 2.

A pair of left and right arms 12, can freely move upward and downward. The arms 12 each have a rear end portion swingably supported by an upper portion of a corresponding one of the main frames 11. The work implement 13 is swingably supported by tip portions (front end portions) of the arms 12.

A pair of two link attachment plates 11*a* is provided at an upper end of each of the main frames 11. Each pair of two link attachment plates 11*a* swingably supports the rear end of the arm 12 and the rear end of the lift cylinder 15.

The arm 12 has a rear end rotatably coupled to the link attachment plates 11*a* and a front end swingably supporting the work implement 13. The arms 12 each include an upper lift arm 21 and a lower lift arm 22.

The upper lift arm 21 can swing upward and downward, with the rear end portion thereof rotatably supported to the link attachment plates 11*a*. A pair of two cylinder attachment plates 21*a* is disposed between a front end portion of a corresponding one of the upper lift arms 21 and a rear end portion (upper end portion) of a corresponding one of the lower lift arms 22. The cylinder attachment plates 21*a* are fixed to both side surfaces of the rear end portion of the lower lift arm 22.

The work implement 13 is a front end attachment of the front loader 1 swingably supported by the arm 12, and is a bucket in the present embodiment. The work implement attached to the tip portions of the arms 12 further includes other front end attachments such as a high-hook fork, a roll fork, a roll grab, a container bucket, a grader, a dozer, and so on.

A pair of left and right link attachment members 13*a* is provided on a rear surface of the work implement 13. The link attachment members 13*a* each couples the tip portion of a corresponding one of the lower lift arm 22 to a dump link 17, in the work implement 13. The work implement 13 is relatively rotatably supported by the tip portions of the lower lift arms 22. Portions of the work implement 13 that are coupled to the lower lift arms 22 are each provided with a pin 13*c*. The work implement 13 is rotatable about the pins 13*c*.

The pair of left and right arms 12 each include the dump link 17. The dump link 17 is coupled between the dump cylinder 16, the arm 12, and the work implement 13, and enables an angle of the work implement 13 relative to the arms 12 to be changed in accordance with the extension/retraction of the dump cylinders 16.

Figure 2:
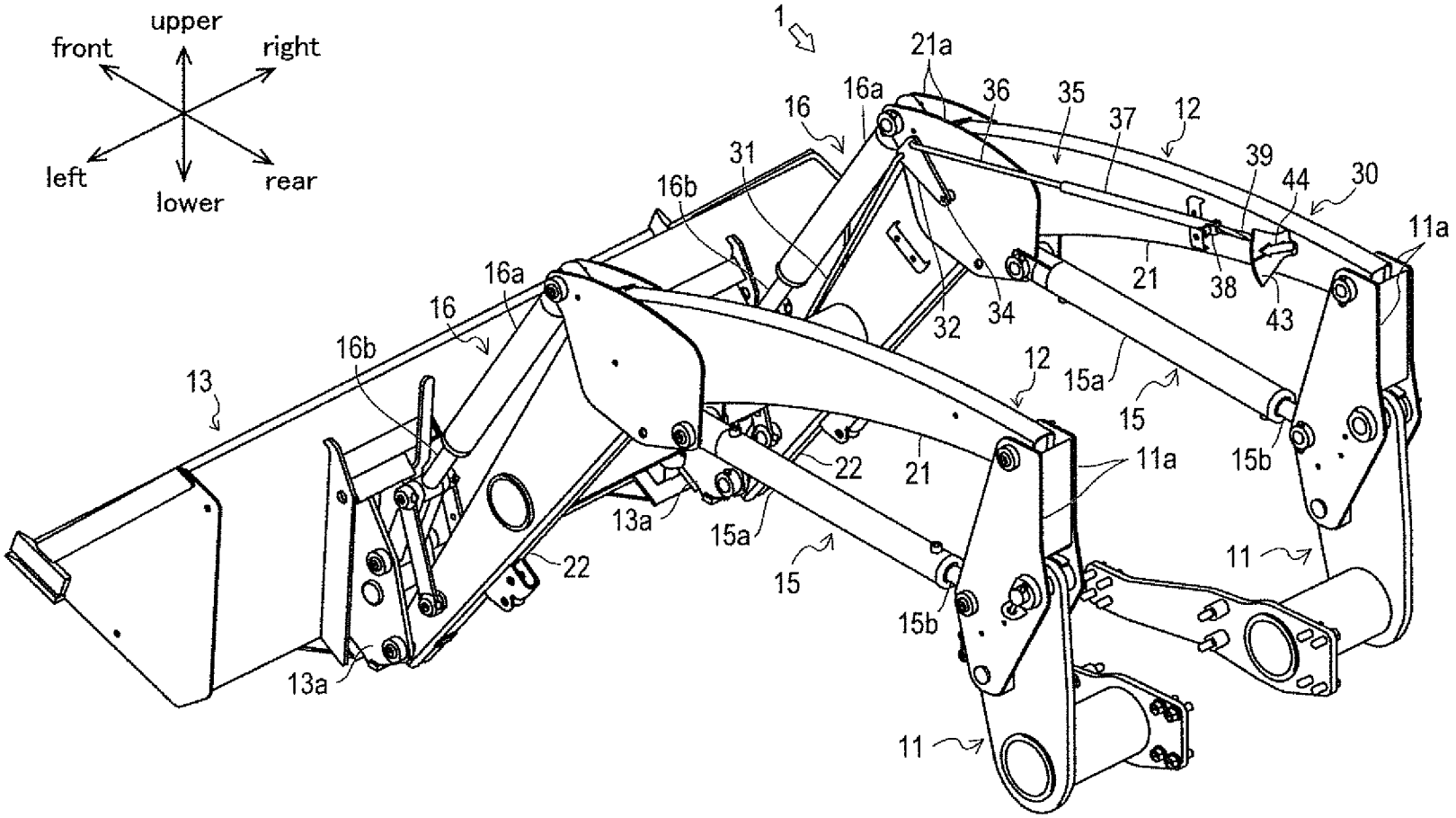
FIG. 2 is a perspective view of the front loader.

As illustrated in FIG. 2, the dump links 17 each include a pair of two arm side coupling plates 17*a* and a work implement side coupling member 17*b* having an approximately H shape. The arm side coupling plates 17*a* are coupled to the dump cylinder 16 and the lower lift arm 22. The work implement side coupling member 17*b* is coupled to the dump cylinder 16 and the link attachment member 13*a*. The dump link 17 is coupled to the dump cylinder 16 with a pin 16*p* inserted into overlapping pin holes including: a pin hole at a crevice of the tip portion of a cylinder rod 16*b*; one pin hole in the coupling plate 17*a*; and one pin hole of the coupling member 17*b*.

The arm side coupling plates 17*a* and the work implement side coupling member 17*b* of the dump link 17 are coupled to the cylinder rod 16*b* via the pin 16*p*. The coupling member 17*b* is coupled to the link attachment member 13*a* via a pin 13*p* inserted in the other pin hole.

Figure 3:
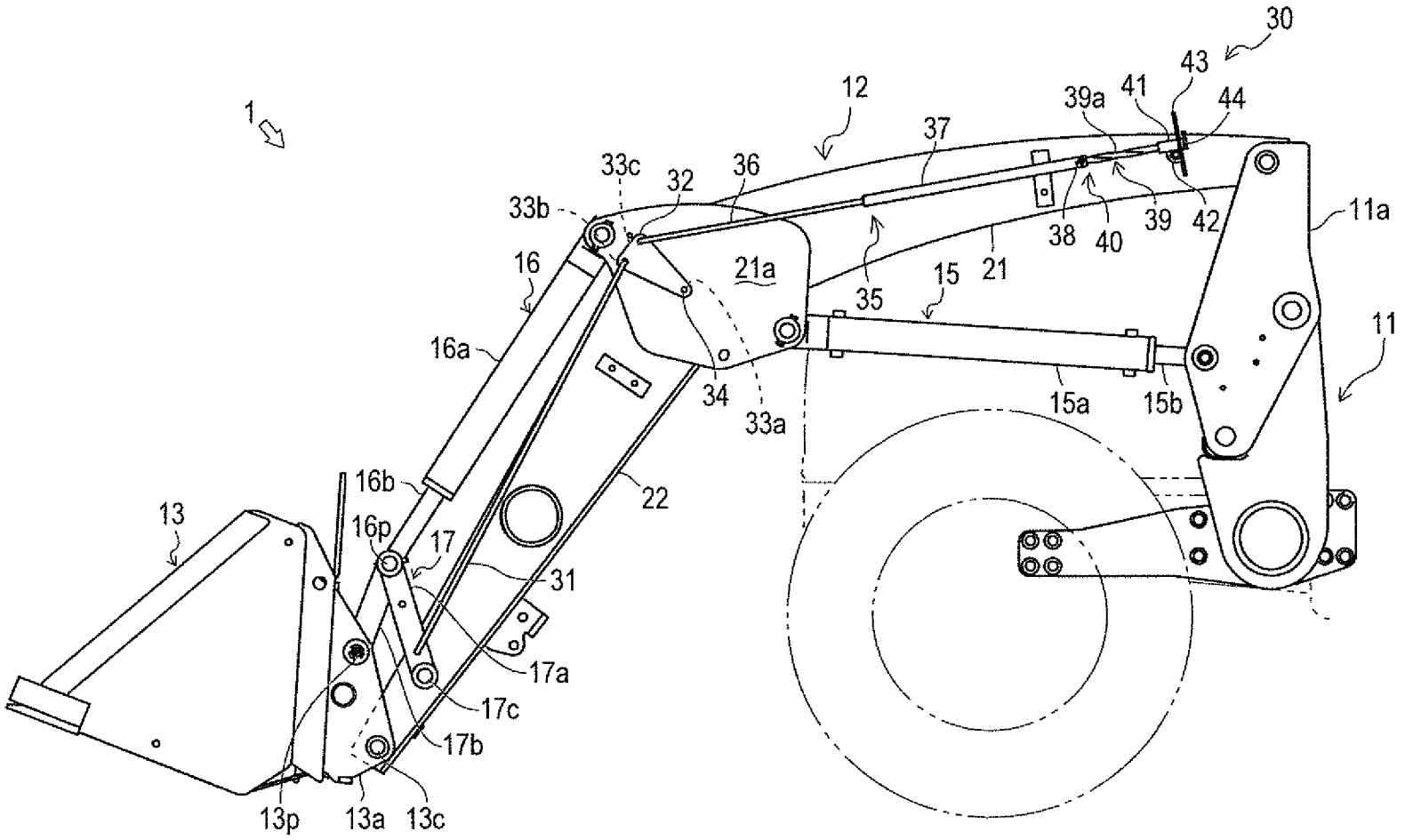
FIG. 3 is a side view of the front loader illustrating one of a pair of arms and a work implement.

As illustrated in FIG. 3, a pin 17*c* is inserted into the other pin hole of the coupling plate 17*a* coupled to the lower lift arm 22, and the coupling plate 17*a* can swing around the pin 17*c*. The pin 17*c* is rotatably attached to a lower portion of the lower link arm 22, and the coupling plate 17*a* is swingable relative to the lower lift arm 22 around the pin 17*c*.

The lift cylinder 15 is a hydraulic cylinder including a cylinder main body 15*a* and a cylinder rod 15*b* slidably inserted into the cylinder main body 15*a*. The cylinder main body 15*a* has a front end portion rotatably supported on a rear side of the cylinder attachment plates 21*a* of the upper lift arm 21 and in addition, the cylinder rod 15*b* has a rear end portion rotatably supported by the link attachment plates 11*a*. With this supporting structure, the cylinder main body 15*a* can freely extend and retract substantially toward the front and the rear, relative to the cylinder rod 15*b*.

The lift cylinder 15 extends and retracts the cylinder rod 15*b* with hydraulic pressure, so that the arm 12 swings in the upper and lower direction, whereby the arm 12 is continuously hoisted and lowered between the highest position and the lowest position (not illustrated). When the lift cylinder 15 operates while the dump cylinder 16 is not operating, the arm 12 can be hoisted and lowered without changing in the posture of the work implement 13 relative to the arm 12.

The dump cylinder 16 is a hydraulic cylinder including a cylinder main body 16*a* and the cylinder rod 16*b* slidably inserted into the cylinder main body 16*a*. The cylinder main body 16*a* has a rear end (upper end) portion rotatably supported at a front side of the cylinder attachment plates 21*a*, and the cylinder rod 16*b* has a front end (lower end) portion rotatably coupled to the dump link 17. With this supporting structure, the cylinder rod 16*b* can extend and retract relative to the cylinder main body 16*a*.

The dump cylinder 16 extends and retracts the cylinder rod 16*b* with hydraulic pressure, so that the work implement side coupling member 17*b* is pressed and pulled, and the arm side coupling plates 17*a* are swung. The operation of the dump cylinder 16 causes the coupling member 17*b* to rotate around the pin 13*p* and causes the work implement 13 to rotate around the pin 13*e*. Thus, the angle of the work implement 13 relative to the arm 12, that is, the posture of the work implement 13 can be changed. When the dump cylinder 16 operates while the lift cylinder 15 is not operating, the work implement 13 swings relative to the arm 12 without hoisting or lowering of the arm 12.

An operation tool (not illustrated) such as a joystick is provided in the cabin 8 of the tractor 10. The lift cylinder 15 and the dump cylinder 16 become operative in accordance with an operation on the joystick. The height position of the work implement 13 coupled to the front end portion of the arm 12 is changed by the operation of the lift cylinder 15 and the angle of the work implement 13 relative to the arm 12 is changed by the operation of the dump cylinder 16.

Next, an angle display device 30 of the front loader 1 is described.

As illustrated in FIG. 3, the front loader 1 includes the angle display device 30. The angle display device 30 is provided on a right side one of the arms 12.

A lower link rod 31 is coupled to a left side coupling plate 17*a* of the two coupling plates 17*a* corresponding to the right side one of the lower lift arms 22 (see FIGS. 2 and 3). One end of the lower link rod 31 is coupled to the coupling plate 17*a* and the other end thereof is coupled to a relay plate 32. The coupling member 17*b* coupled to the work implement 13 via the link attachment member 13*a* transmits the operation of the work implement 13 to the lower link rod 31 via the coupling plate 17*a*. In other words, the dump link 17 including the coupling plate 17*a* and the coupling member 17*b* transmit the operation of the work implement 13, that is, a variation of the angle of the work implement 13 to the lower link rod 31.

A rotational shaft 34 is relatively rotatably supported to an upper end portion of a left side surface of the right side one of the lower lift arms 22. The rotational shaft 34 extends from the right side one of the lower lift arms 22 passing through the cylinder attachment plate 21*a* and protrudes toward the left side lower lift arms 22. This protruding end portion of the rotational shaft 34 is fixed to the relay plate 32, so that the relay plate 32 and the rotational shaft 34 are integrated.

The relay plate 32 is a plate member having an approximately triangular shape. Holes 33*a*, 33*b*, and 33*c* are formed in a portion near a corresponding one of vertices of the relay plate 32. The rotational shaft 34 is relatively unmovably attached to the hole 33*a* as one of these holes. Therefore the relay plate 32 can rotate together with the rotational shaft 34 relative to the right side one of the lower lift arms 22. The lower link rod 31 and the shaft member 35 are respectively coupled to the other two holes 33*b* and 33*c*.

The shaft member 35 includes an upper link rod 36 and a guide tube 37. The upper link rod 36 has one end portion bent to be in a hook shape, and has a linear section between an intermediate portion and the other end. The guide tube 37 has a cylindrical shape. The one end portion of the upper link rod 36 is coupled to the relay plate 32. The other end portion of the upper link rod 36 is inserted into a hollow portion of the guide tube 37 from one end of the guide tube 37 and fixed to the guide tube 37. Thus, the upper link rod 36 and the guide tube 37 are integrated. In this state, an axis of the upper link rod 36 approximately coincides with an axis of the guide tube 37.

Figure 4:
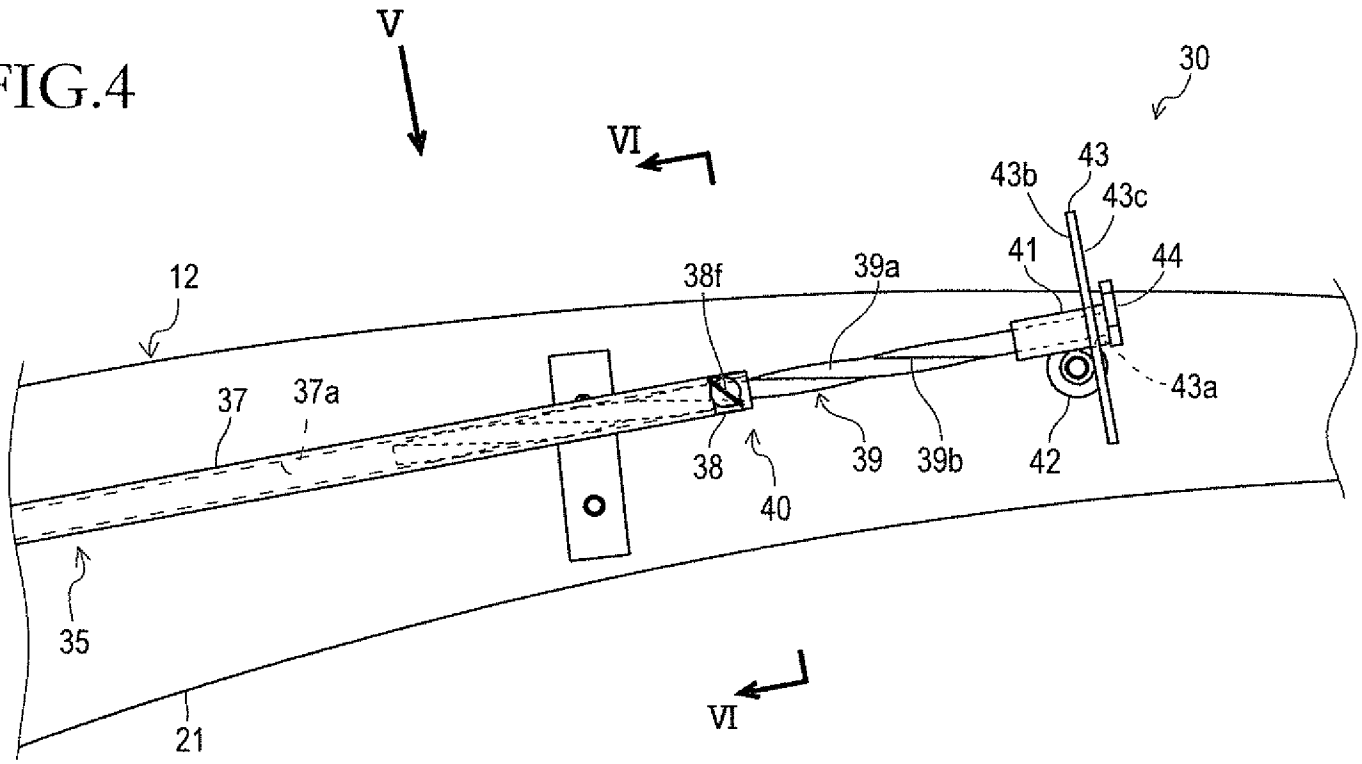
FIG. 4 is an enlarged side view of the front loader illustrating an angle display device formed on one arm.
Figure 5:
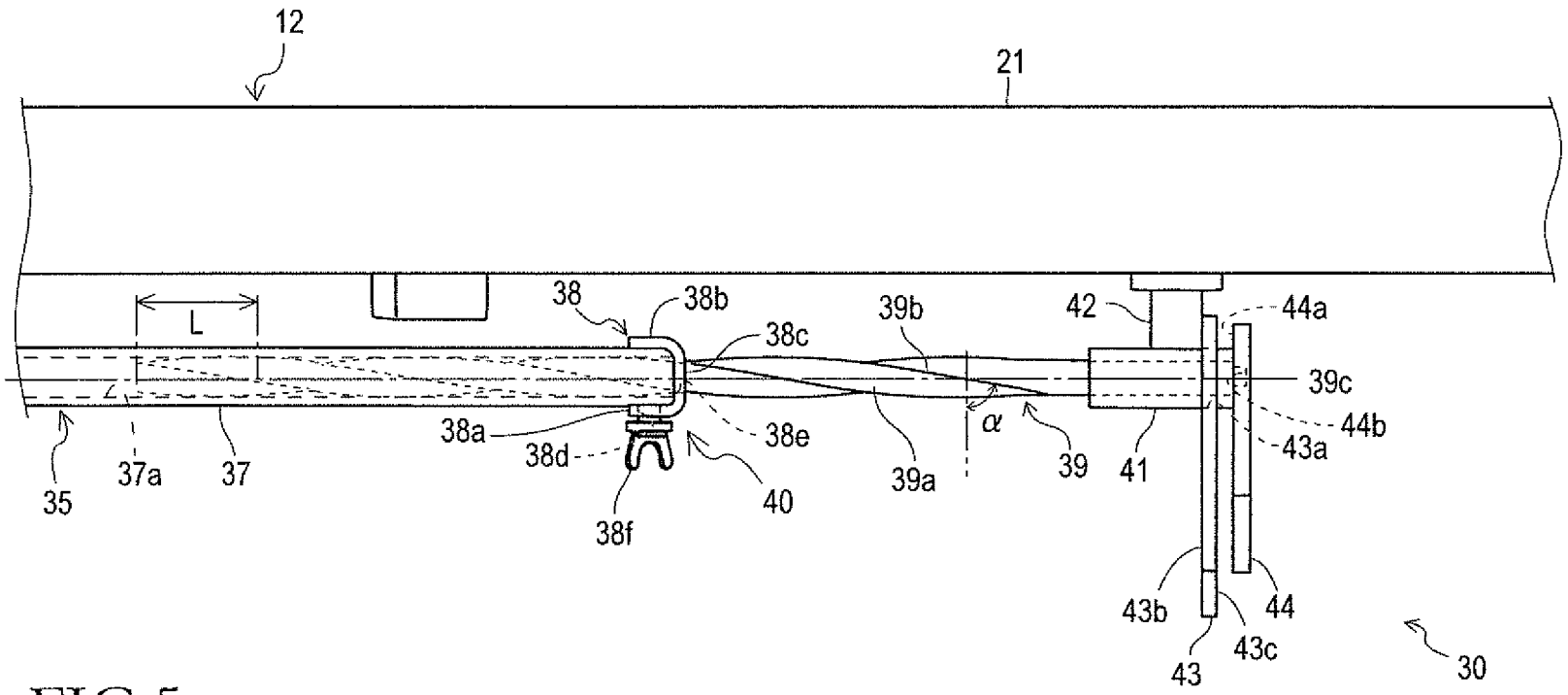
FIG. 5 is a perspective view of the front loader as viewed in a direction of an arrow V in FIG. 4.

As illustrated in FIG. 4, a guide member 38 is attached to the other end of the guide tube 37. As illustrated in FIG. 5, the guide member 38 is a cap member having an approximately U shape. The guide member 38 includes side wall portions 38*a* and 38*b* facing each other and a front wall portion 38*c* connecting the two side wall portions 38*a* and 38*b*. A screw hole 38*d* is formed on either side wall portion 38*a* and passes through the one side wall portion 38*a*.

Figure 6:
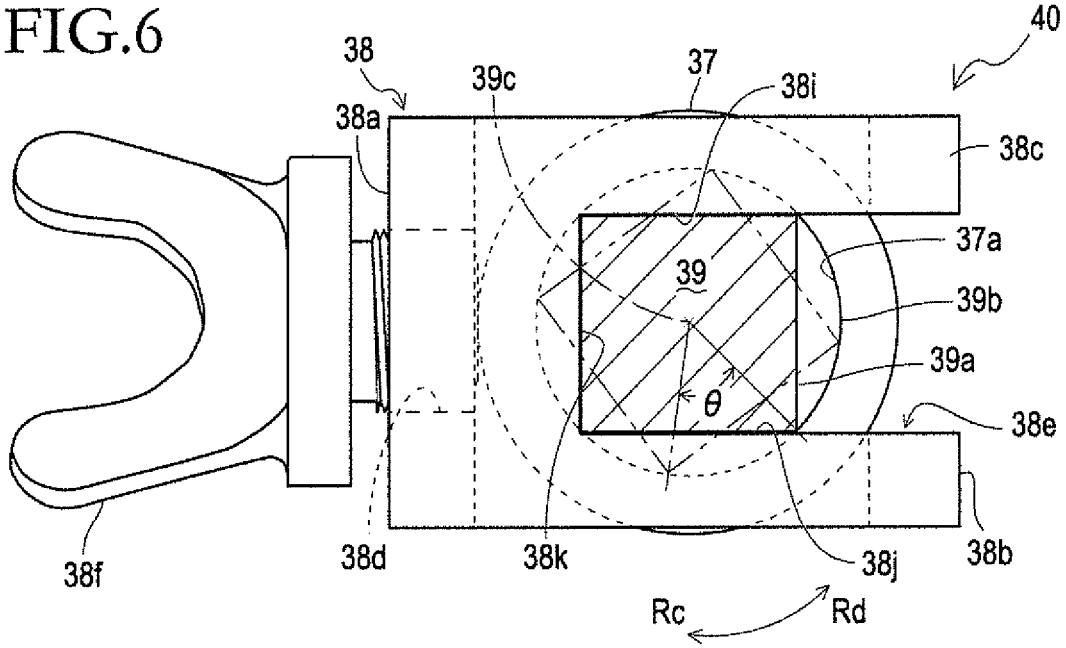
FIG. 6 is a cross-sectional view of an end surface taken along a line VI-VI in FIG. 4, illustrating a guide member and its periphery.

As illustrated in FIG. 6, a guide groove 38*e* extending from the other side wall portion 38*b* to the front wall portion 38*e* is formed in the guide member 38. The guide groove 38*e* is a notched portion that extends from an end of the other side wall portion 38*b* of the guide member 38 to, passes through the front wall portion 38*c*, and reaches a portion around a boundary between either side wall portion 38*a* or the front wall portion 38*c* of the guide member 38. The guide groove 38*e* has three edges including either side edge 38*i*, the other side edge 38*j*, or a bottom edge 38*k*. Either side edge 38*i* or the other side edge 38*j* forms contact surfaces facing each other. A twisted portion 39*a* of a rotation rod 39 described below is fit in the guide groove 38*e*. The guide member 38 and the rotation rod 39 that are attached to the guide tube 37 form a conversion mechanism 40.

As illustrated in FIG. 5, the rotation rod 39 is a rod processed with twisting. The twisted portion 39*a* is formed at its intermediate portion by a twisting process. Thus, the rotation rod 39 has an outer surface provided with a helical protrusion 39*b*. As illustrated in FIG. 6, a shape of a transverse section of the twisted portion 39*a* is polygon and is a square in the present embodiment. A diameter of a circumscribed circle of the transverse section of the twisted portion 39*a* corresponds to an outer diameter of the helical protrusion 39*b*.

The guide member 38 is attached to the other end of the guide tube 37 as each side wall portions 38*a* and 38*b* clamping an outer circumference surface of the guide tube 37 while being disposed at positions separated from each other by 180° in a circumference direction of the outer circumference surface. Thus, the front wall portion 38*c* faces the end surface at the other end of the guide tube 37, and closes partly an opening at the end surface. A wing bolt 38*f* is screwed into the screw hole 38*d* and a tip portion of the wing bolt 38*f* presses the outer circumference surface of the guide tube 37, so that the guide member 38 is fixed to the outer circumference surface of the guide tube 37. Specifically, the position of the guide member 38 relative to the guide tube 37 is determined.

Further, the conversion mechanism 40 is formed with one end portion of the rotation rod 39 relatively rotatably inserted into an internal space of the guide tube 37 through the guide groove 38*e* so that the axis of the guide tube 37 can approximately coincide with an axis 39*c* of the rotation rod 39. The guide tube 37 and the rotation rod 39 are designed to satisfy the following conditions, so that the axis of the guide tube 37 can approximately coincide with the axis 39*c* of the rotation rod 39 and a circumscribed circle of each transverse section of the twisted portion 39*a* of the rotation rod 39 approximately corresponds to a circle defining an inner circumference surface 37*a* of the guide tube 37 as a circumference surface. The helical protrusion 39*b*, accommodated in the guide tube 37, of the rotation rod 39 is in contact with the inner circumference surface 37*a* of the guide tube 37.

Two opposing sides of the four sides of the square of any transverse section of the twisted portion 39*a* are respectively in contact with either side edge 38*i* and the other side edge 38*j* of the guide groove 38*e*. The one end of the rotation rod 39 is inserted into the guide tube 37 in the state of that the helical protrusion 39*b* of the rotation rod 39 is in contact with the two contact surfaces of the guide member 38. One of the remaining two sides is in contact with the bottom edge 38*k* of the guide groove 38*e* and the other one of the two sides is free from the guide member 38. Thus, as described below, when the shaft member 35 moves, the rotation rod 39 rotates around the center of the transverse section, that is, the axis 39*c* while the helical protrusion 39*b* is being in contact with the two side edges 38*i* and 38*j*.

The rotation rod 39 rotates by an angle θ with a maximum rotation angle $\theta_0$ set between a maximum curling angle (see a two dotted chain line in FIG. 9) and a maximum digging angle (see a solid line in FIG. 9) of the work implement 13. In addition, the rotation rod 39 rotates by the angle θ in a curling direction Rc or a digging direction Rd, when the shaft member 35 moves by a distance (length) L illustrated in FIG. 5 relative to the rotation rod 39. A twisting angle (a lead angle of a screw) α of the rotation rod 39 is set so that the relative movement between the rotation rod 39 and the guide tube 37 by the distance L causes the rotation of the rotation rod 39 by the angle θ between the maximum curling angle and the maximum digging angle of the work implement 13.

As illustrated in FIG. 5, the other end portion of the rotation rod 39 has a circular column shape and is inserted in an indicator tube 41. The indicator tube 41 is a tubular member having an opening on each of one and the other ends thereof. The rotation rod 39 is inserted into the indicator tube 41 from one end toward the other end, and passes through the indicator tube 41. At this time, with an axis of the indicator tube 41 approximately coincides with the axis 39*c* of the rotation rod 39.

The hollow portion of the indicator tube 41 has a configuration of restricting the rotation rod 39 to move in the axial direction of the indicator tube 41, and also enabling the rotation rod 39 to rotate around the axis of the indicator tube 41.

Figure 7:
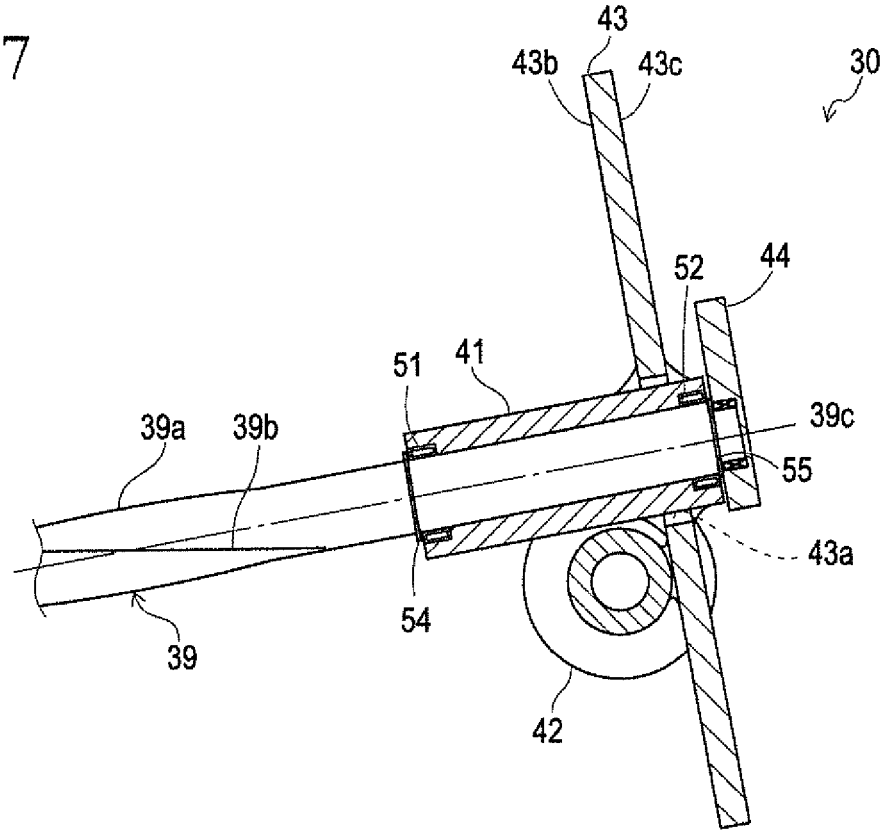
FIG. 7 is a partially enlarged cross-sectional view of the angle display device.

As illustrated in FIG. 7, one end and the other end of the hollow portion of the indicator tube 41 are respectively provided with bearings 51 and 52. The bearing 51 and 52 each have an outer ring supported by the indicator tube 41 and an inner ring is supported by the rotation rod 39.

A configuration of preventing the rotation rod 39 from falling out from the indicator tube 41 is provided between the rotation rod 39 and the indicator tube 41. Two retaining rings 54 and 55 are attached to the other end portion of the rotation rod 39. Either retaining ring 54 is attached to the rotation rod 39 near by the bearing 51 at the one end of the indicator tube 41. The other retaining ring 55 is attached to the rotation rod 39 near by the bearing 52 at the other end of the indicator tube 41.

The angle display device 30 is configured to support the conversion mechanism 40 supported by the upper lift arm 21. A supporting shaft 42 is disposed below the indicator tube 41. The supporting shaft 42 is relatively and rotatably supported at a left side surface of the right side one of the upper lift arms 21.

A scale plate 43 is fixed to the supporting shaft 42 by welding and the like. The scale plate 43 is fixed to the supporting shaft 42 supported by the upper lift arm 21 via the supporting shaft 42.

An opening 43*a*, through which the indicator tube 41 passes, is formed in the scale plate 43. The rotation rod 39 passing through the indicator tube 41 also passes through the scale plate 43 from a rear surface (a surface on the side of the cylinder attachment plate 21*a*) 43*b* to a front surface (a surface on the side of the link attachment plate 11*a*) 43*c*.

The indicator tube 41 is fixed to an edge of the opening 43*a* by welding and the like so that the scale plate 43 is approximately orthogonal to the axis of the indicator tube 41. Thus, the scale plate 43, the supporting shaft 42, and the indicator tube 41 can integrally rotate around the axis of the supporting shaft 42, relative to the side surface of the upper lift arm 21.

Figure 8:
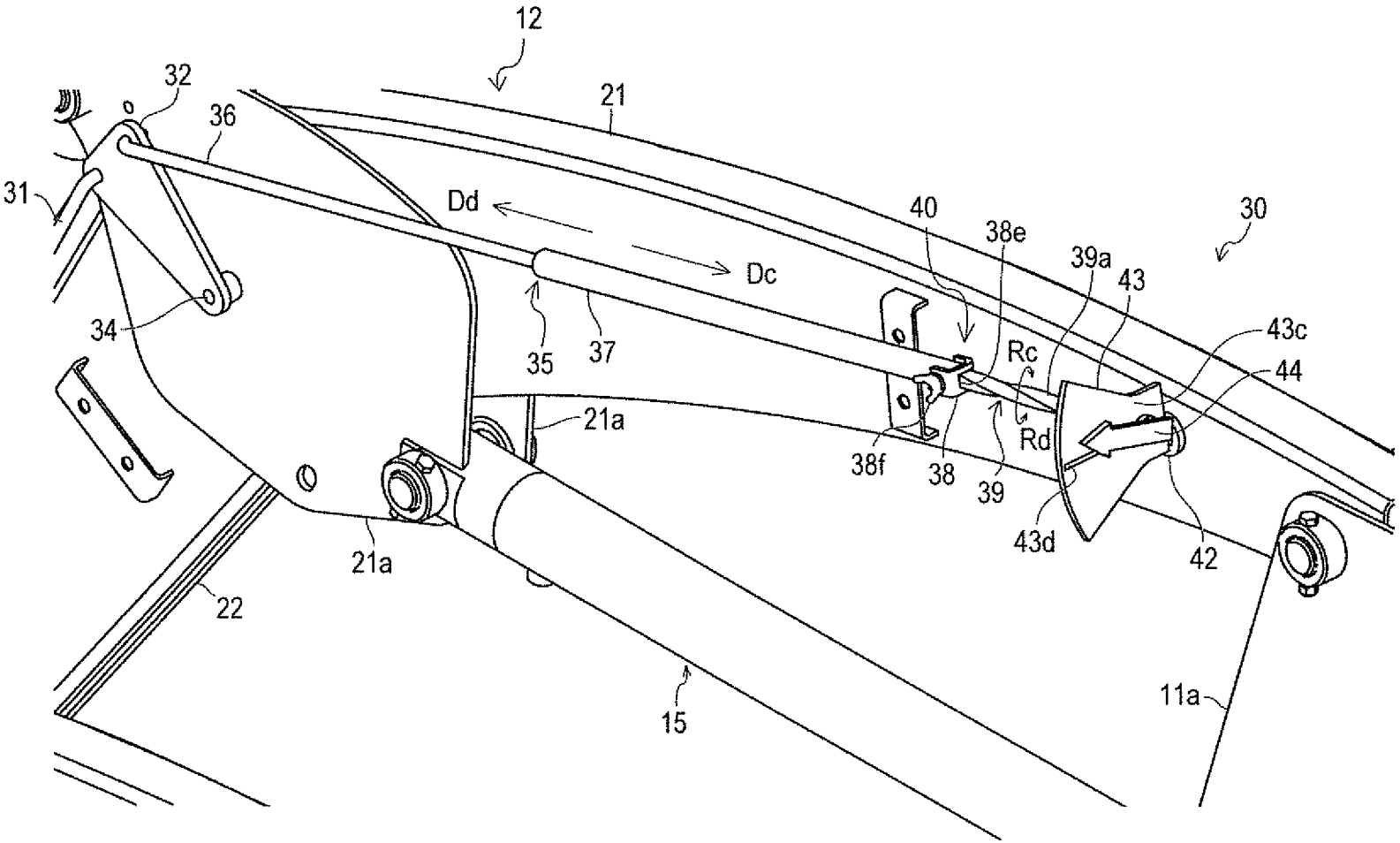
FIG. 8 is an enlarged perspective view of the front loader illustrating the angle display device formed on one arm.

As illustrated in FIG. 8, the front surface 43*c* of the scale plate 43 serving as a gauge member is provided with a reference scale mark 43*d*. The reference scale mark 43*d* indicates a reference angle of the work implement 13 relative to the arm 12. The front surface 43*c* of the scale plate 43 is further provided with: a display indicating a variation of an angle of the work implement 13 in the curling direction such as the word "CURL" for example; and a display indicating a variation of the angle of the work implement 13 in the digging direction such as the word "DIG" for example. A position of the display corresponding to each of the digging direction and the curling direction on the scale plate 43, a twisted direction of the rotation rod 39, and a direction of an arrow of an indicator 44 relative to the rotation rod 39 are associated with each other relative to each direction of the variation of the angle of the work implement 13.

The front surface 43*c* of the scale plate 43 may be provided with a plurality of scale marks that indicate angles of the work implement 13 relative to the arm 12 and include: curling direction scale marks that are on an upper side of the reference scale mark 43*d*; and digging direction scale marks that are on a lower side of the reference scale mark 43*d*.

The indicator 44 is detachably attached to the other end of the rotation rod 39 passing through the indicator tube 41 and the scale plate 43. The indicator 44 is a flat plate member having a shape of an arrow. In the present embodiment, the shape of the cross section of the other end of the rotation rod 39 is circle, but the shape thereof may be a polygon closer to a circle than a quadrangle.

As illustrated in FIG. 5, a recess 44*b* having a shape corresponding to the cross section of the other end of the rotation rod 39 is formed on a rear surface (a surface facing the scale plate 43) 44*a* of the indicator 4. The other end of the rotation rod 39 is connected to the recess 44*b* so as to be detachable freely so that the indicator 44 and the rotation rod 39 can be integrated. Thus, when the rotation rod 39 rotates, the indicator 44 rotates around the axis 39*c* with the rotation rod 39, on the scale plate 43.

An operation of the angle display device 30 is described with reference to FIG. 9. As described above, the angle of the work implement 13 relative to the arm 12 changes along with the operation of the dump cylinder 16.

When the dump cylinder 16 is retracted, along with that the work implement 13 swings in a curling direction R1, the arm side coupling plate 17*a* of the dump link 17 swings in a curling direction R2. The coupling plate 17*a* swings in the curling direction R2, so that the lower link rod 31 is pushed up in a direction toward the relay plate 32 from the work implement 13. Thus, along with that the relay plate 32 rotates in a direction R3 toward the upper side from the lower side about the rotational shaft 34, the shaft member 35 is pressed in the curling direction Dc toward the link attachment plate 11*a* from the cylinder attachment plate 21*a*. In this manner, the shaft member 35 operates in accordance with the variation of the angle of the work implement 13.

Figure 10A:
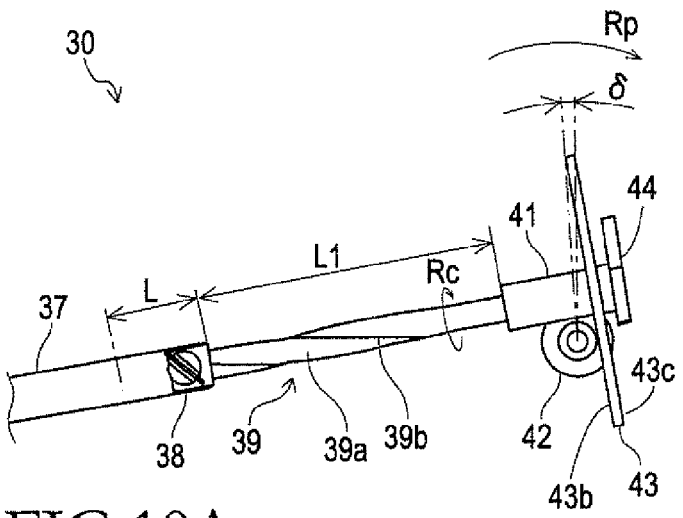
FIG. 10A is a partial side view of the angle display device illustrating an amount of movement of the shaft member relative to the rotation rod in a direction of moving away from the work implement, as well as the shaft member and the rotation rod that integrally swing.

In this process, the position of the one end of the upper link rod 36 of the shaft member 35 moves in a rearward and upward direction, that is, in a direction of moving away from the work implement 13 and in a direction of approaching the supporting shaft 42, so that an amount of the rotation rod 39 moving into the guide tube 37 increases in accordance with the movement amount. At this time, as illustrated in FIG. 10A, a length of a part, exposed from the guide tube 37, of the rotation rod 39 exposed from the guide tube 37 is L1. Thus, when the dump cylinder 16 retracts to the maximum curling angle of the work implement 13, an axial direction length of the angle display device 30 between the one end of the shaft member 35 and the other end of the rotation rod 39 is shorter than that when the dump cylinder 16 extends to the maximum digging angle of the work implement 13, by the predetermined length L. At the same time, the shaft member 35, the rotation rod 39, the indicator tube 41, the supporting shaft 42, and the scale plate 43 rotate around the axis of the supporting shaft 42 by an angle δ relative to the arm 12 in the curling direction Rp.

Figure 10B:
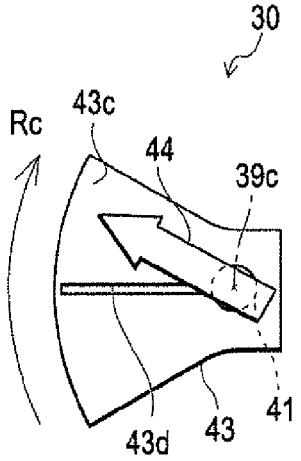
FIG. 10B is a partial rear view of the angle display device illustrating the indicator rotating when the shaft member moves in the direction of moving away from the work implement.

When the shaft member 35 moves along the upper lift arm 21, the protrusion 39*b* of the rotation rod 39 slides along the guide groove 38*e* of the guide member 38, and the rotation rod 39 rotates around the axis 39*c* of the rotation rod 39 in the curling direction Rc (referred to as one direction). When the rotation rod 39 rotates, the indicator 44 integrally rotates with the rotation rod 39 in the curling direction Rc (see FIG. 10B). In this manner, the indicator 44 rotates relative to the scale plate 43 in accordance with the variation of the angle of the work implement 13. The conversion mechanism 40 changes the relative position of the scale plate 43 and the indicator 44 in accordance with the operation of the shaft member 35.

Thus, the configuration from the upper link rod 36 to the indicator 44 can integrally swing around the supporting shaft 42 in accordance with the rotation of the relay plate 32 about the rotational shaft 34, and also the rotation rod 39 can be rotated while changing the length in the axial direction of the configuration from the upper link rod 36 to the indicator 44 changed. When the configuration swigs, the scale plate 43 and the indicator 44 integrally rotate around the supporting shaft 42. Thus, the rear surface 44*a* of the indicator 44 remains to be in parallel with the front surface 43*c* of the scale plate 43, whereby the angle between the scale plate 43 and the indicator 44 stays the same. All things considered, in the angle display device 30, the position of the indicator 44 on the scale plate 43 can be accurately indicated.

Figure 9:
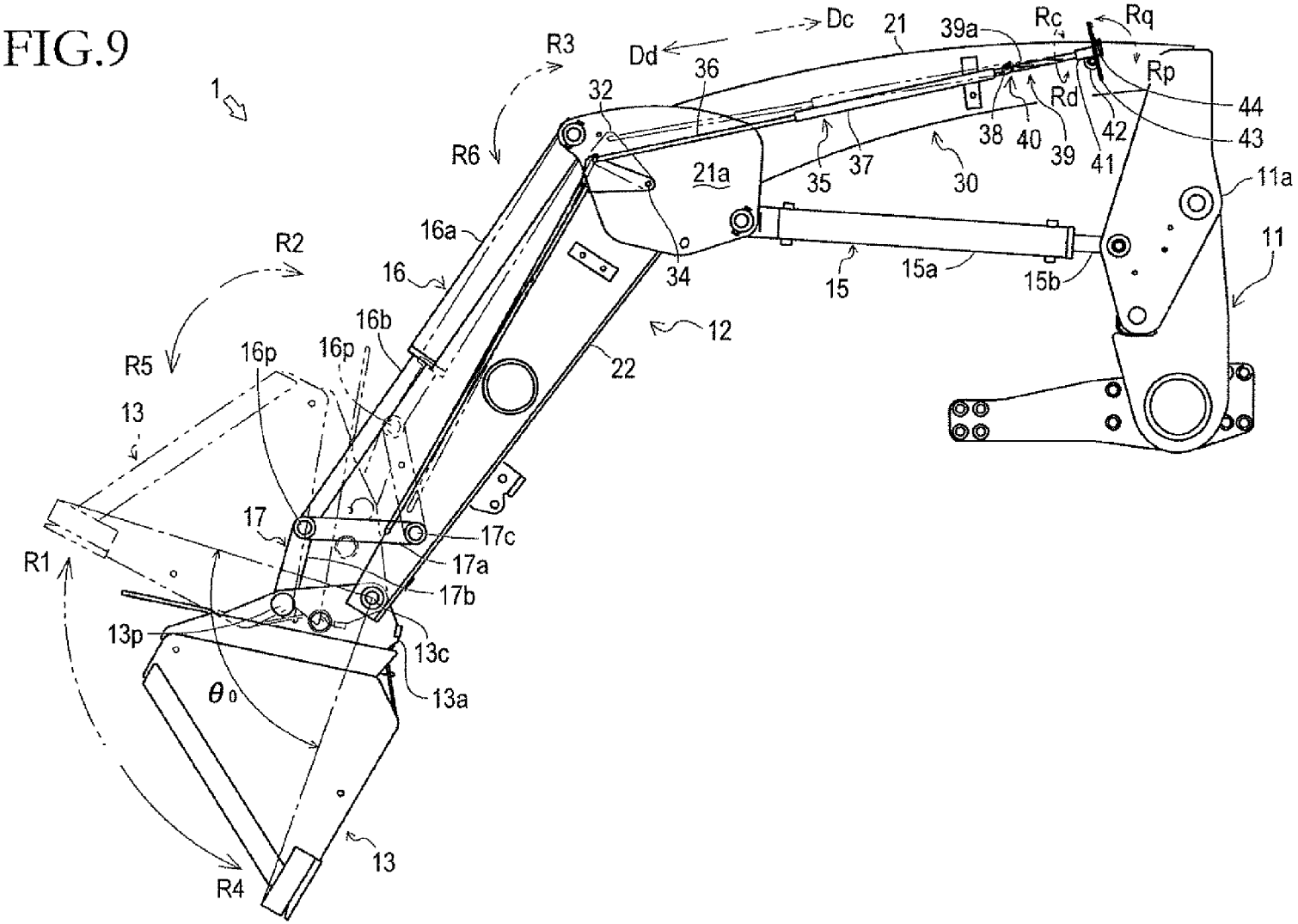
FIG. 9 is a side view of the front loader illustrating a shaft member that moves in accordance with variations of an angle of the work implement, and an indicator rotating in accordance with the movement of the shaft member.

As illustrated in FIG. 9, when the dump cylinder 16 extends, the work implement 13 swings in a digging direction R4, and the arm side coupling plate 17*a* of the dump link 17 swings in a digging direction R5. When the coupling plate 17*a* swings in the digging, direction R5, the lower link rod 31 is pulled in a direction toward the work implement 13 from the relay plate 32. Thus, the relay plate 32 rotates in a direction R6 toward the lower side from the upper side, and the shaft member 35 is pulled in a digging direction Dd toward the cylinder attachment plate 21*a* from the link attachment plate 11*a*. In this manner, the shaft member 35 moves along the arm 12 in accordance with the variation of the angle of the work implement 13 between the maximum curling angle and the maximum digging angle.

Figure 10C:
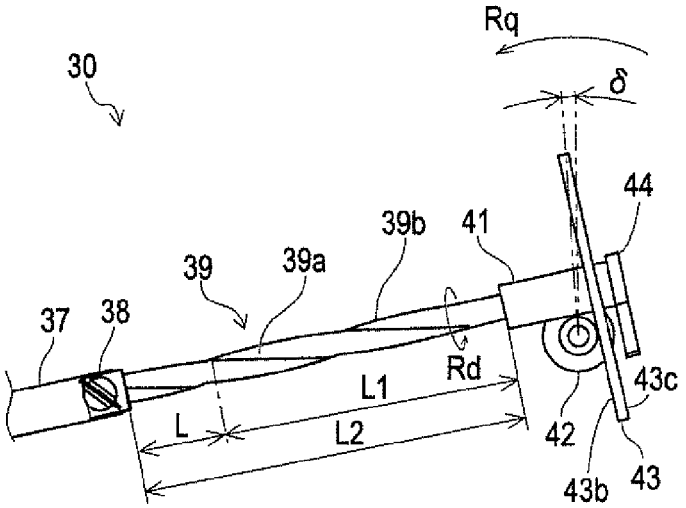
FIG. 10C is a partial side view of the angle display device illustrating an amount of movement of the shaft member relative to the rotation rod in a direction of moving toward the work implement, as well as the shaft member and the rotation rod that integrally swing.

In this process, the position of the one end of the upper link rod 36 of the shaft member 35 moves in the downward and forward direction, that is, in a direction of approaching the work implement 13 and of moving away from the supporting shaft 42, so that an amount of the rotation rod 39 moving into the guide tube 37 decreases in accordance with the movement amount. As illustrated in FIG. 10C, the part of the rotation rod 39 exposed from the guide tube 37 has a length L2. Thus, when the dump cylinder 16 extends to the maximum digging angle of the work implement 13, an axial direction length of the angle display device 30 between the one end of the shaft member 35 and the other end of the rotation rod 39 is longer than that when the dump cylinder 16 retracts to the maximum curling angle of the work implement 13, by the length L. At the same time, the shaft member 35, the rotation rod 39, the indicator tube 41, the supporting shaft 42, and the scale plate 43 rotate around the axis of the supporting shaft 42 by the angle δ relative to the arm 12 in the digging direction Rq.

Figure 10D:
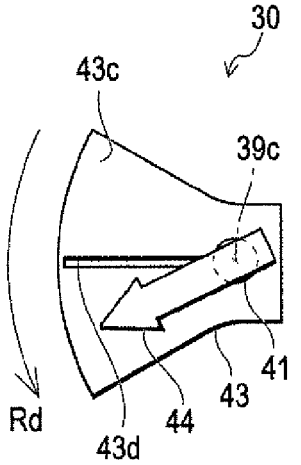
FIG. 10D is a partial rear view of the angle display device illustrating the indicator rotating when the shaft member moves in the direction of moving toward the work implement.

When the shaft member 35 moves along the upper lift arm 21, the protrusion 39*b* of the rotation rod 39 slides along the guide groove 38*e* of the guide member 38, and the rotation rod 39 rotates around the axis 39*c* of the rotation rod 39 in the digging direction Rd (referred to as the other direction opposite to the one direction). Further, the indicator 44 integrally rotates with the rotation rod 39 in the digging direction Rd (see FIG. 10D). In this manner, the conversion mechanism 40 converts the movement of the shaft member 35 into rotary force, in such a manner that the indicator 44 rotates relative to the scale plate 43 in the curling direction Rc or the digging direction Rd according to the movement of the shaft member 35.

The front surface 43*c* of the scale plate 43 is arranged approximately orthogonal to the axial direction of the shaft member 35 along the side surface of the upper lift arm 21, to face the rear surface of the front loader 1 (see FIGS. 2 and 3). Thus, the angle display device 30 enables the operator on the tractor 10 including the front loader 1 to visually recognize the scale plate 43 easily while sitting on the driver's seat.

Further, the indicator 44 is fixed to the other end of the rotation rod 39 in such a manner as to rotate on a plane extending to approximately orthogonally cross the axial direction. As described above, the scale plate 43 is approximately orthogonal to the axis of the indicator tube 41, that is, the axial direction of the shaft member 35. Thus, the indicator 44 rotates on the plane approximately parallel with the front surface 43*c* of the scale plate 43. All things considered, a configuration is achieved where the angle display device 30 enables the operator to clearly visually recognize the position of the indicator 44 relative to the reference scale mark 43*d* on the scale plate 43, instead of making the operator determine the positional relationship between the indicator 44 and the scale plate 43 with the operator's perspective.

The conversion mechanism 40 has a configuration for adjusting a zero-point position of the indicator 44. The zero-point position is the position of the indicator 44 pointing the reference scale mark 43*d* on the scale plate 43. Preferably, the zero-point position serves the center between the maximum curling angle and the maximum digging angle of the work implement 13.

The angle display device 30 has a configuration in which the position of the guide member 38 on the outer circumference surface of the guide tube 37 is changeable along the circumference direction of the outer circumference surface. The guide member 38 can be attached to a desired position in the circumference direction of the outer circumference surface of the guide tube 37. When the wing bolt 38*f* is loosen, the operator can cause to move the position of the guide member 38 in the outer circumference surface of the guide tube 37 along the circumference direction of the outer circumference surface while the rotation rod 39 stays inserted into the guide groove 38*e* of the guide member 38. Thus, the rotation rod 39 integrally rotates with the indicator 44, whereby the position of the indicator 44 (in other words, an orientation of the indicator 44) on the scale plate 43 can be adjusted as appropriate. After adjusting the zero-point position as appropriate, the operator tightens the wing bolt 38*f* so that the guide member 38 can be fixed to the guide tube 37.

In this configuration, even when the position of the indicator 44 relative to the reference scale mark 43*d* is displaced, the zero-point position of the indicator 44 can be adjusted with that the position of the guide member 38 in the circumference direction of the outer circumference surface of the guide tube 37 is being changed as appropriate. Further, the zero-point position is adjusted for each work implement 13 replaced for the arm 12, so that the front loader 1 can respond appropriately to a replacement of the work implement 13.

The conversion mechanism according to the present invention is not limited to the configuration in which the two contact surfaces of the guide member 38, that is, the side edges 38*i* and 38*j* of the guide groove 38*e* contact the helical protrusion 39*b* of the rotation rod 39. A configuration of an alternative conversion mechanism 60 is described below with reference to FIG. 11. Configurations described below that are the same as the configurations of the conversion mechanism 40 are denoted with the same reference numerals, and the description thereof will be omitted.

Figure 11:
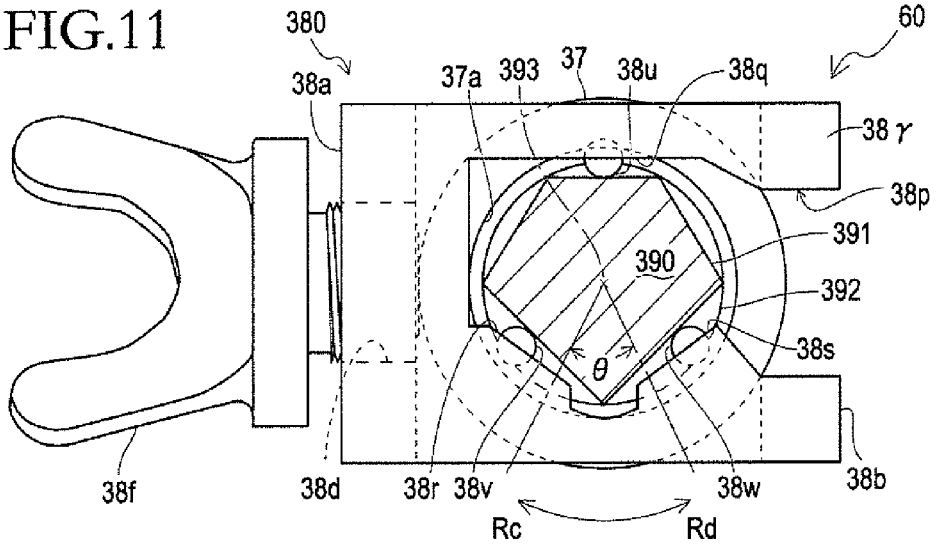
FIG. 11 is a cross-sectional end surface view of another exemplary conversion mechanism illustrating a guide member and a periphery thereof.

As illustrated in FIG. 11, the conversion mechanism 60 includes a guide member 380 and a rotation rod 390. The guide member 380 is attached to the other end of the guide tube 37, that is, an end opposite to a side coupled to the relay plate 32. The guide member 380 includes the side wall portions 38*a* and 38*b* facing each other and a front wall portion 38γ connecting between the one side wall portion 38*a* and the other side wall portion 38*b*. When the guide member 380 is attached to the guide tube 37, the front wall portion 38γ faces the end surface of the other end of the guide tube 37 to close partly the opening of the end surface.

A guide groove 38*p* extending from the other side wall portion 38*b* to the front wall portion 38γ is formed on the guide member 380. The guide groove 38*p* is a notched portion that extends from an end of the other side wall portion 38*b* of the guide member 380, passes through the front wall portion 38γ, and reaches a portion close to a boundary between the one side wall portion 38*a* and the front wall portion 38γ. The guide groove 38*p* includes a plurality of side edges each having a protrusion formed thereon and three side edges 38*q*, 38*r*, and 38*s* are included in the conversion mechanism 60. Balls 38*u*, 38*v*, and 38*w*, serving as the protrusions, are each rotatably embedded in a corresponding one of the side edges 38*q*, 38*r*, and 38*s*.

Instead of each ball 38*u*, 38*v*, and 38*w*, a roller may be used, a rib may be formed on each side edge, or a protrusion may be attached afterwards.

A twisted portion 391 is formed in an middle portion of the rotation rod 390 by the twisting process. Thus, the rotation rod 390 has an outer surface provided with a helical protrusion 392. In the present embodiment, a shape of the transverse section of the twisted portion 391 is polygon, which is a combination of an isosceles trapezoid and an isosceles triangle. A longer bottom side of two bottom sides of the isosceles trapezoid coincides with the bottom side of the isosceles triangle in the transverse section. A diameter of a circumscribed circle of the transverse section of the twisted portion 391 corresponds to an outer diameter of the helical protrusion 392.

One end portion of the rotation rod 390 is relatively rotatably inserted into the inner space of the guide tube 37 through the guide groove 38*p*, in such a manner that the axis of the guide tube 37 approximately coincides with an axis 393 of the rotation rod 390. At this time, among five sides of the pentagon at any transverse section of the twisted portion 391: a shorter bottom side of the bottom sides of the trapezoid is in contact with the ball 38*u*; and equal sides of the isosceles triangle are in contact with the balls 38*v* and 38*w*.

The one end of the rotation rod 390 is inserted into the guide tube 37 with the three balls 38*u*, 38*v*, and 38*w* of the guide member 380 respectively being in contact with different sides of the transverse section of the rotation rod 390. The remaining two sides of the transverse section are free from the guide member 380. Thus, when the shaft member 35 moves, the rotation rod 390 rotates around the axis 393 with the three balls 38*u*, 38*v*, and 38*w* of the guide member 380 respectively being in contact with different sides of the transverse section of the rotation rod 390. Although not elaborated in the figure, the indicator 44 is attached to the other end of the rotation rod 390 to be integrated with the rotation rod 390. Thus, as in the angle display device 30 including the conversion mechanism 40 described above, the indicator 44 rotates relative to the scale plate 43 together with the rotation rod 390 when the rotation rod 390 rotates.

As illustrated in the figure, when an apex of the isosceles triangle points downward, the protrusion, such as the ball 38*u*, may not be provided to the side edge 38*q* on the opposite side of the apex with respect to the axis 393. The conversion mechanism 60 can bring the equal sides of the isosceles triangle, as lower ones of the five sides of the pentagon at any transverse section of the twisted portion 391, into contact with the balls 38*v* and 38*w* by utilizing the own weight of the rotation rod 390. As illustrated in the figure, when the outer diameter of the helical protrusion 392 is smaller than the diameter of the inner circumference surface 37*a* of the guide tube 37, it is not mandatory that the axis 393 of the rotation rod 390 coincides with the axis of the guide tube 37.

In the present invention, the shaft member may not include the guide tube 37 and may be formed of an upper link rod. A configuration of another alternative conversion mechanism 70 is described below with reference to FIGS. 12A and 12B. In the description below, configurations that are the same as the configurations in the conversion mechanism 40 are denoted with the same reference numerals, and the description thereof will be omitted.

Figure 12A:
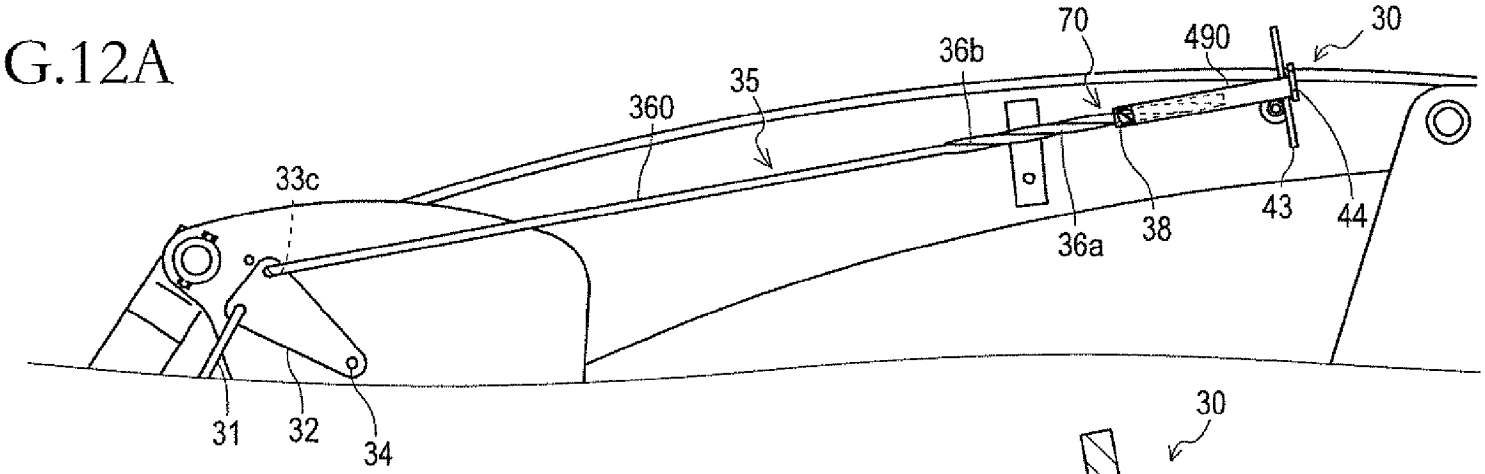
FIG. 12A is an enlarged side view of the front loader illustrating an angle display device including still another exemplary conversion mechanism.

As illustrated in FIG. 12A, the conversion mechanism 70 includes: an upper link rod 360 as the shaft member 35; a rotational tube 490 into which the upper link rod 360 is inserted; and the guide member 38 attached to one end of the rotational tube 490. The one end portion of the shaft member 35, formed of the upper link rod 360, is coupled to the relay plate 32 as described above, and the other end portion thereof is relatively rotatably inserted into the rotational tube 490 via the guide member 38.

A twisted portion 36*a* is formed on the other end portion of the upper link rod 360 by the twisting process. Thus, a part of the upper link rod 360 inserted into the rotational tube 490, that is, the twisted portion 36*a* has the helical protrusion 36*b*. A shape of the transverse section of the twisted portion 36*a* is a polygon, and the shape thereof is square in the conversion mechanism 70.

Figure 12B:
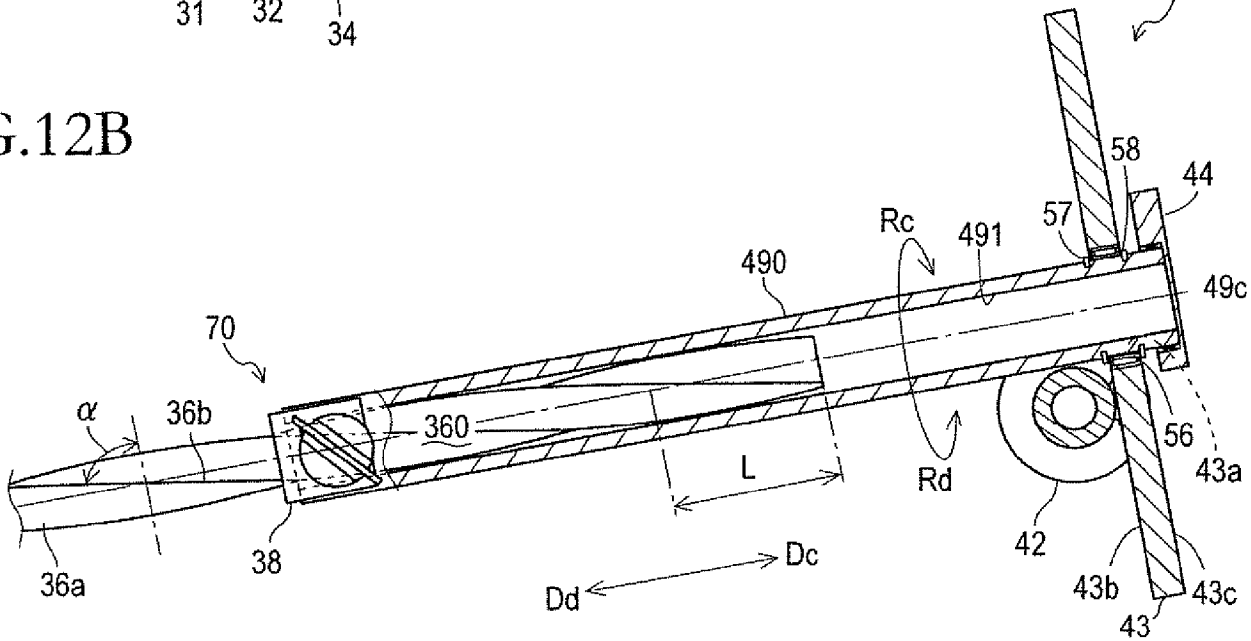
FIG. 12B is a partially enlarged cross-sectional view of the angle display device including this still another exemplary conversion mechanism.

As illustrated in FIG. 12B, the other end portion of the rotational tube 490 is provided with a configuration of enabling the rotational tube 490 to rotate around the axis 49*c*, while providing with the configuration of restricting the rotational tube 490 to move in the axial direction. The rotational tube 490 passes through the scale plate 43. A bearing 56 is press fitted to the opening 43*a* of the scale plate 43. An outer ring of the bearing 56 is an outer ring supported by the scale plate 43 and an inner ring thereof is supported by the rotational tube 490. Two retaining rings 57 and 58 are attached to the outer circumference surface of the rotational tube 490. One retaining ring 57 is attached to the rotational tube 490 while facing the rear surface 43*b* of the scale plate 43 and being in contact with the inner ring of the bearing 56. The other retaining ring 58 facing the surface 43*e* of the scale plate 43 and being in contact with the inner ring of the bearing 56 is attached to the rotational tube 490

The conversion mechanism 70 is formed with the other end portion of the upper link rod 360 relatively rotatably inserted into the inner space of the rotational tube 490 through the guide groove 38*e* (see FIG. 6). At this time, the axis of the upper link rod 360 approximately coincides with the axis 49*c* of the rotational tube 490 and a circumscribed circle of each transverse section of the twisted portion 36*a* of the upper link rod 360 approximately corresponds to a circle defining the inner circumference surface 491 of the rotational tube 490 as a circumference surface. The helical protrusion 36*b* at the part of the upper link rod 360 accommodated in the rotational tube 490 contacts the inner circumference surface 491 of the rotational tube 490.

Two opposite sides of four sides of a square at any traverse section of the twisted portion 36*a* contact the one side edge 38*i* and the other side edge 38*j* of the guide groove 38*e* (see FIG. 6). The other end of the upper link rod 360 is inserted into the rotational tube 490, with the helical protrusion 36*b* of the upper link rod 360 being in contact with the two contact surfaces of the guide member 38 as described above. One side of the remaining two sides contacts the bottom edge 38*k* (see FIG. 6) of the guide groove 38*e*, and the other side is free from the guide member 38. Thus, when the shaft member 35 moves relative to the rotational tube 490 within a range of the distance L, the rotational tube 490 rotates in a range of the angle θ (see FIG. 6) around the axis 49*c*, with the helical protrusion 36*b* being in contact with at least the two side edge 38*i* and 38*j* (see FIG. 6).

The indicator 44 is detachably attached to the other end of the rotational tube 490, so that the indictor 44 can be integral with the rotational tube 490. Thus, when the rotational tube 490 rotates, the indicator 44 rotates around the axis 49*c* along with the rotational tube 490, on the scale plate 43.

As described above, the scale plate 43 is rotatably supported by the upper lift arm 21 via the supporting shaft 42. Thus, the other end portion of the rotational tube 490 is restricted to move in the axial direction of the rotational tube 490 relative to the upper lift arm 21, and is supported to the arm 12 so as to be rotatable freely relative to the arm 12 with the scale plate 43 and the indicator 44 around a predetermined rotation axis, that is, the axis of the supporting shaft 42. The angle display device 30 including the conversion mechanism 70 may include a ball screw (not illustrated) that supports a portion between the one end portion and the other end portion of the upper link rod 360. The ball screw is preferably fixed to the upper lift arm 21.

The conversion mechanism 70 is not limited to the configuration in which the helical protrusion 36*b* of the upper link rod 360 contacts the two contact surfaces of the guide member 38, that is, the side edge 38*i* and 38*j* of the guide groove 38*e*. A guide member on which a plurality of protrusions are formed may be attached to one end of the rotational tube 490, as in the case of the guide member 380 of the conversion mechanism 60 illustrated in FIG. 11. The other end of the upper link rod 360 may be inserted into the rotational tube 490 with the protrusions of the guide member described above respectively being in contact with different sides of any transverse section of the twisted portion 36*a* having a polygonal shape.

The angle display device according to the present invention may have a configuration in which the gauge member rotates relative to the indicator so that the relative position between the gauge member and the indicator can change. For example, the angle display device including the indicator fixed to the arm and the gauge member integrated with the rotation rod or the rotational tube can rotate the gauge member relative to the indicator.

The conversion mechanism according to the present invention may have any configuration in which the movement of the shaft member 35 is converted into rotary force so that the indicator 44 can rotate around a rotational axis in parallel with the axis of the shaft member 35 relative to the scale plate 43 in the one direction or the other direction, in accordance with the movement of the shaft member 35. For example, a mechanism including rack and pinion, or a mechanism including a combination of an electric motor and gears may be employed.

The conversion mechanism may have a configuration in which the amount of movement of the shaft member 35 is converted into a digital signal, and an electric motor coupled to the indicator automatically rotates in accordance with the digital signal. Alternatively, the conversion mechanism may have a configuration in which the gauge member and the indicator are displayed on a display device including a liquid crystal display, and the indicator automatically rotates relative to the gauge member in the one direction and in the other direction in accordance with the digital signal, on the display device.

The device described in the description above is merely a recommended example. It is apparent for a person skilled in the art that the present invention can be modified and applied in various ways without departing from the range defined by the scope of claims described below.

What is claimed is:

1. A front loader comprising:

an arm having an upper lift arm and a lower lift arm and formed in a chevron shape in a side view;

a work implement supported by a tip portion of the arm; and an angle display device including:

a gauge member having a scale indicating an angle of the work implement relative to the arm;

an indicator being movable relative to the gauge member according to variations of the angle of the work implement;

a shaft member being movable along the upper lift arm according to variations of the angle of the work implement;

a lower link rod being movable along the lower lift arm according to variations of the angle of the work implement;

a relay plate disposed between the shaft member and the lower link rod and rotatably supporting the shaft member and the lower link rod; and a conversion mechanism changing a relative position of the gauge member and the indicator according to the movement of the shaft member;

wherein, the conversion mechanism is configured so as to cause the indicator to rotate relative to the gauge member around a rotation axis being parallel to an axis of the shaft member in one direction or another direction according to the movement of the shaft member, and wherein the shaft member, lower link rod and the relay plate are arranged within a width of the upper lift arm and the lower lift arm in the side view.

2. The front loader according to claim 1, wherein the shaft member includes a guide tube;

wherein the conversion mechanism includes a rotation rod and a guide member;

wherein the rotation rod includes a helical protrusion;

wherein a part of the rotation rod having the helical protrusion having a transverse section in the shape of a polygon:

wherein the guide member is provided integrally with the guide tube so as to close partly an opening of an end surface of the guide tube;

wherein the guide member is formed with two contact surfaces;

wherein one end portion of the rotation rod is inserted into the guide tube from the end surface so that the helical protrusion contacts two contact surfaces of the guide member; and wherein the indicator is attached to another end portion of the rotation rod integral with the rotation rod.

3. The front loader according to claim 2, wherein the other end portion of the rotation rod is restricted to move linearly along an axial direction of the rotation rod relative to the arm and is supported so as to be rotatable relative to the arm around a prescribed rotation axis with the gauge member and the indicator.

4. The front loader according to claim 1, wherein the shaft member includes a guide tube;

wherein the conversion mechanism includes a rotation rod and a guide member;

wherein the rotation rod includes a helical protrusion;

wherein a part of the rotation rod having the helical protrusion having a transverse section in the shape of a polygon;

wherein the guide member is provided integrally with the guide tube so as to close partly an opening of an end surface of the guide tube;

wherein the guide member is formed with a plurality of projections;

wherein one end portion of the rotation rod is inserted into the guide tube from the end surface so that the plurality of projections of the guide member contact respective different sides of the polygonal transverse section; and wherein the indicator is attached to another end portion of the rotation rod integrally with the rotation rod.

* * * * *